US006736912B1

(12) United States Patent
Fields et al.

(10) Patent No.: US 6,736,912 B1
(45) Date of Patent: May 18, 2004

(54) COMBUSTIBLE COMPOSITIONS FOR AIR-AUGMENTED ROCKET ENGINES

(76) Inventors: Jerry L. Fields, 6825 Dyer Ct., Springfield, VA (US) 22150; James D. Martin, 1007 Pickett Pl., Vienna, VA (US) 22180

( * ) Notice: Subject to any disclaimer, the term of this patent is extended or adjusted under 35 U.S.C. 154(b) by 0 days.

(21) Appl. No.: 05/783,919

(22) Filed: Mar. 24, 1977

(51) Int. Cl.[7] ..... C06B 45/10

(52) U.S. Cl. ..... 149/19.9; 149/19.91; 149/7; 149/21; 149/19.1; 60/253

(58) Field of Search ..... 149/19.3, 19.9, 149/19.91, 21, 7, 19.1; 60/253

(56) References Cited

U.S. PATENT DOCUMENTS 3,203,171 A * 8/1965 Burke et al. ..... 149/87
3,520,742 A * 7/1970 Witz ..... 149/7
3,536,532 A * 10/1970 Watanabe et al. ..... 136/83
3,646,174 A * 2/1972 Macri, II ..... 264/3 C
3,761,330 A * 9/1973 Low et al. ..... 149/21
3,904,501 A * 9/1975 Lagow et al. ..... 204/164
3,986,909 A * 10/1976 Macri ..... 149/19.9
4,003,771 A * 1/1977 Lubowitz ..... 149/19.3

* cited by examiner

*Primary Examiner*—Edward A. Miller
(74) *Attorney, Agent, or Firm*—Nixon & Vanderhye, PC

(57) ABSTRACT

A solid combustible composition for use in solid fuel air-augmented rocket engines which very substantially increases the temperature efficiency of afterburner fuel combustion with ram air, thereby greatly increasing engine performance. The improvement comprises dispersing in a matrix comprising the solid, fuel-rich organic compositions conventionally utilized in air-augmented rockets, particles containing solid oxidizable element and fluorine oxidizer compound which reacts with the element to produce gaseous subfluoride compound.

45 Claims, 1 Drawing Sheet

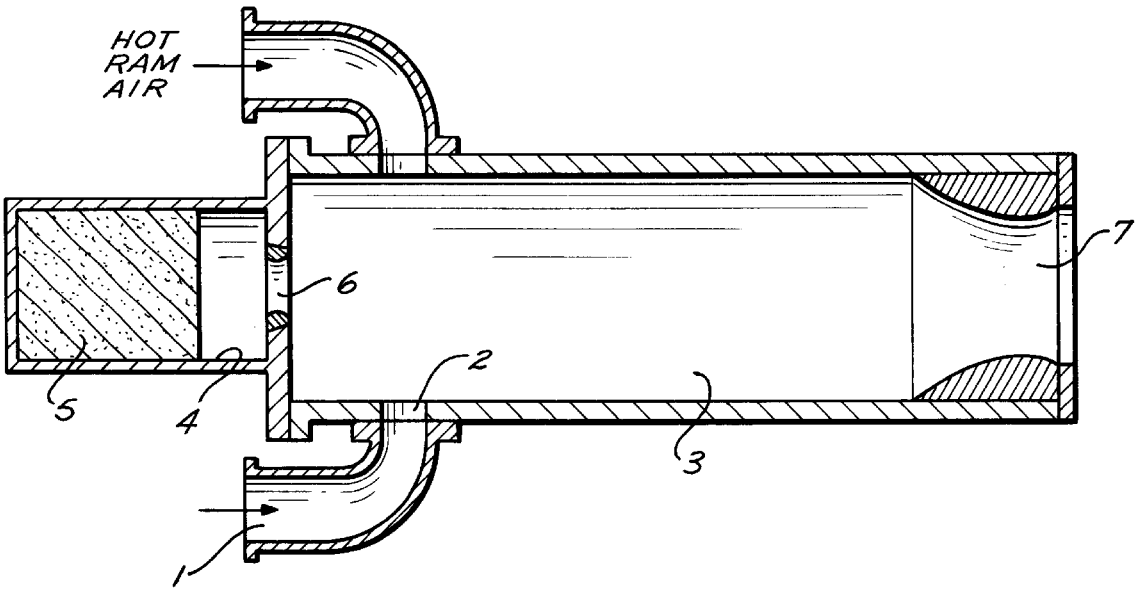
HOT
RAM
AIR
1
2
3
4
5
6
7

COMBUSTIBLE COMPOSITIONS FOR AIR-AUGMENTED ROCKET ENGINES

BACKGROUND

State-of-the-art air-augmented rocket engines obtain jet thrust by burning an organic, fuel-rich composition containing oxidizer sufficient to maintain combustion but insufficient for complete oxidation of the fuel components; ejecting the resulting fuel-rich combustion products into an afterburner; and then mixing high pressure, heated ram air with the fuel-rich products of combustion, thereby obtaining secondary combustion in the afterburner. Temperature efficiency, which is the ratio of actual combustion temperature obtained to the theoretically obtainable temperature, is directly proportional to theoretical engine performance and is therefore frequently employed to define performance efficiency. In general, such efficiency has been relatively low, ranging from about 40% to 70%, the latter being obtained under the most favorable conditions. Because of the relatively low combustion temperatures which can drop below ignition temperature of the organic fuel-rich composition, it has been the practice to employ flame stabilizers and flame holders to improve combustion efficiency and increase temperature by providing areas of turbulent mixing. Unfortunately, such expedients also result in a pressure drop which tends to decrease overall system propulsive efficiency.

The present invention increases temperature efficiency to as high as about 90% to 100%, thereby greatly improving air-augmented rocket engine performance. The improvement, furthermore, is accomplished at relatively low cost in terms of fuel-rich composition modification and can accomplish substantial savings in cost and dead weight by very considerably reducing the mixing and combustion chamber volume downstream of the fuel-rich grain presently required in the state-of-the-art air-augmented rocket engine. It is also believed that the high-temperature gaseous subfluorides improve mixing of the ram air, act as ignition aids for the ram air-organic fuel-rich combustion products, and may provide adequate turbulent mixing to make possible elimination of flame holders.

SUMMARY

Combustible compositions of particular utility in air-augmented rocket engines comprising (a) an organic fuel-rich matrix containing insufficient oxidizer for complete combustion; and (b) solid fuel-rich particles, dispersed in the matrix, comprising at least one oxidizable solid element having a single stable valence and the ability to produce a gaseous subfluoride; and at least one solid oxidizer compound having combined therein as an oxidizer element, fluorine available to oxidize the oxidizable solid element to subfluoride; the oxidizable element and oxidizer compound being present in the fuel-rich particles in amounts sufficient to react to produce an appreciable amount of the gaseous subfluoride.

BRIEF DESCRIPTION OF THE DRAWING

The FIGURE shows a schematic sketch of a conventionally designed air-augmented rocket engine.

DETAILED DESCRIPTION

The organic fuel-rich composition may be composite, namely comprising a conventional inert organic polymer binder, such as polybutadiene carboxy- or hydroxy-terminated polybutadiene, polyurethanes, polyesters, polyvinyls, and the like, and a separate solid oxidizer, e.g., ammonium or alkali-metal perchlorates or nitrates, or self-oxidant, such as nitrocellulose plasticized with nitroglycerine, cyclotetramethylene tetranitramine, and the like. Additionally, the composition can contain dispersed therein finely divided solid fuel components, such as B, Mg, C, polystyrene beads, Zr, Al, and the like. It will be understood that the term "fuel-rich composition or matrix containing solid oxidizer sufficient to maintain combustion but insufficient for complete combustion of fuel component" includes both the composite and self-oxidant compositions defined above.

The solid, fuel-rich particles of the invention, as aforedescribed, comprise a solid, oxidizable element which has a single stable valence and the ability to react with a fluorine-containing solid oxidizer to produce a subfluoride. As is well known to anyone skilled in the chemical art, the subfluorides are underoxidized compounds which readily oxidize to higher stable fluorides. The elements which are characterized by the above-identified properties are readily determined by those skilled in the art from available literature, including, for example, thermodynamic tables.

The element can be a metal,such as Zr, Al, Mg, Be, the alkali metals, such as Na, K, Li, Cs, and the like, or a non-metal, such as B, C, or the like. In general, the preferred elements are Al, Mg, and B.

The solid fluorine-containing oxidizer can be, for example, fluorinated crystalline carbon, e.g., natural or synthetic graphite, which has the formula $(CF_x)_n$, Teflon, the difluoroamino adduct of trivinoxypropane (TVOPA), 2,3 (difluoroamino) propyl methacrylate, and the like.

In general, the preferred fluoro-compound is $(CF_x)_n$. This compound and the process for making it are described in such literature as N. Watanabe et al U.S. Pat. No. 3,536,532. The compound appears to be a structure wherein the fluorine is disposed within the carbon crystal lattice layer. The compounds are thermally stable up to temperatures as high as about 500° C., and highly chemical and corrosion resistant. They have variously been used as fluorinating agents, lubricants, and electrodes. The relative proportion of fluorine (x) to carbon can be varied by variations in $(CF_x)_n$ production conditions, such as the concentrations of graphite and fluorine. The specific value of "x" is not critical to the invention so long as it is present in sufficient amount to react with the oxidizable element.

Production of the desired subfluoride is ensured by maintaining the oxidizable element in excess. The subfluorides, as compounds, are well known in the art and do not, therefore,require detailed description here. Simply by way of example, the highly exothermic reaction of Al plus $(CF_x)_n$ produces high temperature gaseous AlF. When admixed with the ram air, the AlF subfluoride reacts exothermically with $O_2$ to produce AlOF which further reacts with $O_2$, generally downstream of the air-augmented rocket exit nozzle, to stable $Al_2O_3$.

The oxidizable element/oxidizer particles can be made in a variety of ways. They can be made, for example, by mixing the finely-divided components, consolidating them under high pressure, and then comminuting the resulting cake into particles of the desired size. A conventional binder can be incorporated into the mixture prior to compression to facilitate adhesion. The binder, though it can be inorganic, e.g., a silicate, is preferably organic, e.g., an organic polymer, so that it contributes as a fuel in the overall composition rather than as dead weight.

Although the particles can be of any shape, including the irregular shapes produced by comminution of the pressed mixture as described above, it is preferred, for improved processing reasons, that they be spheroidal. Spheroidal particles can be produced in a variety of ways described in the literature. A particularly preferred way is described in Macri, U.S. Pat. No. 3,646,174. The process as described therein for making spheroidal agglomerates of particulates bonded by a matrix of an organic polymer, comprises mixing the solid particles with an organic liquid prepolymer curable to a solid polymer, and a volatile liquid which is immiscible with the prepolymer and does not dissolve the solid particles; and continuously agitating the resulting mixture while removing the volatile liquid. During such simultaneous agitation and removal, the prepolymer and solids coalesce into globules containing the particles dispersed therein. The agitation and removal continues until the prepolymer sets into a solid polymer.

The amount of binder employed in the particles is not critical though use of a minor amount, e.g., less than 50% by weight of the particle and preferably less than 10%, is generally preferred.

The size of the particles can vary within a broad range, it being important only that they be sufficiently small relative to the size of the organic fuel grain, that they can be homogeneously dispersed to provide spaced release of the subfluoride. They can, in some instances, be as large as one-half inch or larger. In general, it is preferred that they be about 10 $\mu$ to 1000 $\mu$ in average size.

The amount by weight of the particles dispersed in the organic fuel matrix must be at least sufficient to provide appreciable amounts of the subfluoride. Beyond that it can be included in amounts which give the maximum attainable temperature efficiency for a particular air-augmented rocket engine of given design and organic fuel-rich charge. This can be determined by routine experiment. In general, amounts by weight can be as high as 80%, though generally it will be adequate to employ minor amounts, namely less than 50% by weight of the total composition.

The FIGURE is a schematic illustration of a typical solid fuel air-augmented rocket engine. Ram air, which is generally additionally heated by combustion of injected $H_2$ and $O_2$ at an upstream point not shown, flows through ram air duct 1 and then through orifice inlet 2, into afterburner chamber 3. Combustion chamber 4 contains seated therein solid fuel-rich grain 5 and is provided with nozzle 6 for ejection of the fuel-rich combustion products produced by combustion of grain 5 into afterburner 3, where it mixes with the ram air. Secondary, substantially complete combustion occurs in the afterburner, and the secondary combustion products exit through nozzle 7 to generate jet thrust. The comparative tests described in the following Example are illustrative of the invention and demonstrate the large increase in temperature efficiency obtained.

EXAMPLE

A test air-augmented rocket engine as shown in the Figure was sequentially fired with the following two identically-sized fuel grains.

Test grain compositions by weight

1. Control composition:
   CTPB[1]/ 39%
   CLPS[2]/ 35%
   AP[3]/ 22%
   $Fe_2O_3$ 1%
   Catocene[4]/ 3%
2. Subfluoride-forming composition:
   Matrix:
   Same as composition of 1 supra except for reduction of CTPB to 34%
   Beads 5%
   $((CF_x)_n$ −52%) (x=0.9)
   (Al−48%)
   1/ Carboxyterminated polybutadiene
   2/ Cross-linked polystyrene beads
   3/ Ammonium perchlorate
   4/ Burning rate additive The results of the firing tests are shown in the following Table:

| | #1 | #2 |
|---|---|---|
| Ram air Temperature | 900° R | 900° R |
| Air/fuel ratio | 22 | 21 |
| Temp. efficiency | 67% | 89% |

It will be seen from the above results that the temperature efficiency in the case of Test #2, the subfluoride-forming composition, was increased by more than 22% in absolute terms. The temperature efficiency measurement is a function of heat actually and theoretically produced by combustion of the organic fuel-rich matrix as well as the heat produced by combustion of the dispersed oxidizable element/oxidizer particles of the invention.

Although this invention has been described with reference to illustrative embodiments thereof, it will be apparent to those skilled in the art that the principles of this invention can be embodied in other forms but within the scope of the claims.

We claim:

1. A combustible composition comprising:

a. a solid organic fuel-rich matrix containing oxidizer sufficient to maintain combustion of the matrix but insufficient for complete combustion of the fuel component;

b. solid fuel-rich particles dispersed therein, said fuel-rich particles consisting essentially of:

(i) at least one oxidizable solid element characterized by a single stable valence and the ability to produce gaseous subfluoride;

(ii) solid oxidizer compound having combined therein a fluorine oxidizer element, said oxidizer element being available for oxidation of said oxidizable element;

(iii) said oxidizable element and said oxidizer compound being present in said fuel-rich particles in amounts sufficient to react to produce an appreciable amount of gaseous subfluoride; and c. said subfluoride being capable of being ejected as an underoxidized combustion product despite the presence of sufficient amounts of oxidizer in said matrix to sustain combustion of said composition.

2. The composition of claim 1 in which the oxidizable element is selected from the group consisting of B, C, Zr, Al, Mg, Be, alkali metal, and mixtures thereof.

3. The composition of claim 2 in which the oxidizable element is selected from the group consisting of B, Al, Mg, and mixtures thereof.

4. The composition of claim 3 wherein the oxidizable element is Al.

5. The composition of claim 1 wherein the oxidizer compound in the dispersed particles is graphite polyfluoride $(CF_x)_n$.

6. The composition of claim 2 wherein the oxidizer compound in the dispersed particles is graphite polyfluoride $(CF_x)_n$.

7. The composition of claim 3 wherein the oxidizer compound in the dispersed particles is graphite polyfluoride $(CF_x)_n$.

8. The composition of claim 4 wherein the oxidizer compound in the dispersed particles is graphite polyfluoride $(CF_x)_n$.

9. The composition of claim 1 wherein the organic fuel matrix is carboxy-terminated polybutadiene.

10. The composition of claim 5 wherein the organic fuel matrix is carboxy-terminated polybutadiene.

11. The composition of claim 6 wherein the organic fuel matrix is carboxy-terminated polybutadiene.

12. The composition of claim 7 wherein the organic fuel matrix is carboxy-terminated polybutadiene.

13. The composition of claim 8 wherein the organic fuel matrix is carboxy-terminated polybutadiene.

14. The composition of claim 9 wherein the organic fuel matrix contains dispersed therein particles of cross-linked polystyrene.

15. The composition of claim 10 wherein the organic fuel matrix contains dispersed therein particles of cross-linked polystyrene.

16. The composition of claim 11 wherein the organic fuel matrix contains dispersed therein particles of cross-linked polystyrene.

17. The composition of claim 12 wherein the organic fuel matrix contains dispersed therein particles of cross-linked polystyrene.

18. The composition of claim 13 wherein the organic fuel matrix contains dispersed therein particles of cross-linked polystyrene.

19. The composition of claim 1 wherein said fuel-rich particles are spheroidal.

20. The composition of claim 3 wherein said fuel-rich particles are spheroidal.

21. The composition of claim 4 wherein said fuel-rich particles are spheroidal.

22. The composition of claim 11 wherein said fuel-rich particles are spheroidal.

23. The composition of claim 12 wherein said fuel-rich particles are spheroidal.

24. The composition of claim 13 wherein said fuel-rich particles are spheroidal.

25. The composition of claim 14 wherein said fuel-rich particles are spheroidal.

26. The composition of claim 15 wherein said fuel-rich particles are spheroidal.

27. In an air-augmented rocket engine which contains a solid organic fuel-rich composition containing solid oxidizer sufficient to maintain combustion but insufficient for complete combustion of fuel component, the improvement comprising: said organic composition containing dispersed therein solid fuel-rich particles consisting essentially of:

(i) at least one oxidizable solid element characterized by a single stable valence and the ability to produce gaseous subfluoride; and (ii) solid oxidizer compound having combined therein a fluorine oxidizer element, said oxidizer element being available for oxidation of said oxidizable element;

(iii) said oxidizable element and said oxidizer compound being present in said fuel-rich particles in amounts sufficient to react to produce an appreciable amount of gaseous subfluoride.

28. The engine of claim 27 wherein the oxidizable element is selected from the group consisting of B, C, Zr, Al, Mg, Be, alkali metal, and mixtures thereof.

29. The engine of claim 28 wherein the oxidizable element is selected from the group consisting of B, Al, Mg, and mixtures thereof.

30. The engine of claim 29 wherein the oxidizable element is Al.

31. The engine of claim 27 wherein the oxidizer compound in the dispersed particles is graphite polyfluoride $(CF_x)_n$.

32. The engine of claim 28 wherein the oxidizer compound in the dispersed particles is graphite polyfluoride $(CF_x)_n$.

33. The engine of claim 29 wherein the oxidizer compound in the dispersed particles is graphite polyfluoride $(CF_x)_n$.

34. The engine of claim 30 wherein the oxidizer compound in the dispersed particles is graphite polyfluoride $(CF_x)_n$.

35. The engine of claim 31 wherein the organic fuel is carboxy-terminated polybutadiene.

36. The engine of claim 33 wherein the organic fuel is carboxy-terminated polybutadiene.

37. The engine of claim 27 wherein said fuel-rich particles are spheroidal.

38. The engine of claim 28 wherein said fuel-rich particles are spheroidal.

39. The engine of claim 29 wherein said fuel-rich particles are spheroidal.

40. The engine of claim 31 wherein said fuel-rich particles are spheroidal.

41. The engine of claim 32 wherein said fuel-rich particles are spheroidal.

42. The engine of claim 33 wherein said fuel-rich particles are spheroidal.

43. The engine of claim 34 wherein said fuel-rich particles are spheroidal.

44. The engine of claim 35 wherein said fuel-rich particles are spheroidal.

45. The engine of claim 36 wherein said fuel-rich particles are spheroidal.

* * * * *